US005319833A

United States Patent [19]

Köhl et al.

[11] Patent Number: 5,319,833

[45] Date of Patent: Jun. 14, 1994

[54] APPARATUS FOR PRODUCING COILS FROM SPRING STEEL MATERIAL

[75] Inventors: Hans Köhl, Plochingen; Jörg Weinschenk, Aichwald; Martin Hoffmann, Nürtingen, all of Fed. Rep. of Germany

[73] Assignee: Stop-Choc Schwingungstechnik GmbH, Fed. Rep. of Germany

[21] Appl. No.: 915,822

[22] PCT Filed: Feb. 5, 1991

[86] PCT No.: PCT/EP91/00218

§ 371 Date: Jul. 28, 1992

§ 102(e) Date: Jul. 28, 1992

[87] PCT Pub. No.: WO91/12100

PCT Pub. Date: Aug. 22, 1991

[30] Foreign Application Priority Data

Feb. 12, 1990 [DE] Fed. Rep. of Germany ..... 4004187

[51] Int. Cl.[5] ..... B21F 31/00

[52] U.S. Cl. ..... 29/33 S; 72/129; 72/132; 72/134; 140/112

[58] Field of Search ..... 72/129, 130, 132, 133, 72/134, 146; 29/33 S, 33 Q, 564.6, 564.8; 140/112

[56] References Cited

U.S. PATENT DOCUMENTS

| | | | |
|---|---|---|---|
| 3,952,569 | 4/1976 | Lauterjung | 72/134 |
| 4,365,492 | 12/1982 | Kortan et al. | 72/132 |

FOREIGN PATENT DOCUMENTS

| | | |
|---|---|---|
| 670848 | 1/1966 | Belgium . |
| 1041902 | 10/1958 | Fed. Rep. of Germany . |
| 3012297 | 10/1981 | Fed. Rep. of Germany . |
| 3710143 | 10/1988 | Fed. Rep. of Germany . |
| 1571634 | 6/1969 | France . |
| 986854 | 3/1965 | United Kingdom . |
| 1109582 | 4/1968 | United Kingdom . |

*Primary Examiner*—Mark Rosenbaum
*Attorney, Agent, or Firm*—Fred Philpitt

[57] ABSTRACT

Apparatus for producing coils of spring steel material comprising an unwinding station, a cutting station, a winding spindle which contains angled gripping wires on its peripheral surface and conveying means for conveying the spring steel material from the cutting station to the winding spindle.

27 Claims, 16 Drawing Sheets

16
26
36
38
30
34
24
32
28
y
22
14
18
12
20
10

40
16
10
20
14
12
42
18

APPARATUS FOR PRODUCING COILS FROM SPRING STEEL MATERIAL

The invention relates to an apparatus for producing coils from spring steel material.

Coils of spring steel material are an intermediate product in the production of all-metal spring cushions. The material was hitherto manually cut to length and coiled. The outer end of the piece of material is fixed manually by a steel wire to the underneath layers. This fixing must be secure so that the outermost layer of material holds firm reliably not solely at the time.of the step of compacting the material in a press, but also later at the time of use of the spring cushion, in order that the spring cushion does not unwind or in order that there is no risk of injury.

The present invention intends to provide an apparatus which facilitates automated production of coils from spring steel material.

This object is achieved according to the invention by an apparatus shown in the drawings.

The present invention has an advantage with regard to the simple and reliable gripping of spring steel material.

With the development of the invention according to one embodiment it is ensured tha at the time of movement of the conveyor am in one direction, the gripping means come automatically into engagement with the material, whereas the withdrawal of the conveyor arm in the other direction automatically results in a removal of the gripping means from the material. Thus, at the time of the with-drawal, the gripping means are able to slide on the spring steel material and do not need to be raised completely from the material. Thus the returning conveyor arm may grip and brake the material, which is an advantage with regard to a clean and uniform coiling of the material.

The development of the invention according to another embodiment is an advantage with regard to reliable gripping and good alignment of the gripped section of the spring steel material with the plane of movement of the conveyor arm. If areas of the end of the material were to hang down, then the location of the end of the material on the winding spindle would be made more difficult.

With the development of the invention according to another embodiment it is ensured that when applying the first layers of material to the winding spindle, the conveyor arm can still slide on the material and press on the latter. The increase in diameter of the coil is in this case compensated for by tilting the end section of the conveyor arm. At the time of withdrawing to the initial position, the conveyor arm then travels with sliding friction on the upper side of the material, the tiltable end section returning increasingly to the position aligning with the main section of the conveyor am. In this case, the tiltable end section, which supports the gripping means, stretches and extends the material and thus contributes to uniform winding.

The development of the invention according to another embodiment is an advantage with regard to a reliable return of the tiltable end section of the conveyor arm into the position aligning with the main section of the conveyor arm and with regard to a uniform tensioning and spreading action upon the return of the conveyor arm.

In an apparatus according to another embodiment, the front and rear end position of the conveyor arm can be adjusted in a simple manner. A readjustment of these end positions is then respectively necessary if one changes from one type of coil to another type of coil.

The development of the invention according to another embodiment has the advantage that one can use winding spindles of different diameter. One can thus produce sleeve-like coils with a different internal diameter on the same apparatus and for conversion one needs solely to tilt the common frame of the cutting station and conveyor arm guide so that the conveyor arm runs substantially tangentially to the winding spindle.

The development of the invention according to another embodiment is an advantage with regard to solid and tight winding of the material strip on the winding spindle.

In an apparatus according to another embodiment, between the adjacent pressing fingers of the pressing device, one has access to the outermost layers of the wound material strip. At these points, one can then connect the outermost layers of the material strip permanently to each other.

In an apparatus according to another embodiment, fixing heads of a fixing station engage between the pressing fingers of the pressing device and in this way it is possible to undertake the fixing of the outermost layer of material strip in the immediate vicinity of its end. One thus has solely a very short section of the material strip projecting beyond the fixing point. This is an advantage with regard to easy handling of the material coil and with regard to avoiding In an apparatus according to another embodiment, one can also use a fixing station of this type, which requires a reaction force for producing an attachment point between the outermost layers of the material coil.

The development of the invention according to another embodiment is an advantage with regard to a simple introduction of the support part: the latter can be introduced in practice unhindered below the end of the material still projecting from the coil on account of its bending stiffness, whereupon then, using the pressing device, the remainder of the material is rolled on the coil.

The development of the invention according to another embodiment ensures that when producing the attachments for the end of the material, the coil is reliably fixed in the direction of rotation. Thus the coil cannot deviate under the forces exerted by the fixing heads.

With the development of the invention according to another embodiment, it is ensured that coils having a different outer diameter can be closed in the fixing station.

With the development of the invention according to another embodiment, it is ensured that the fixing of the outer end of the material takes place reliably, securely and without adding a material of any other type. Microwelding provides the necessary mechanical strength without weakening the material in the vicinity of the welds.

Even the development of the invention according to another embodiment is an advantage with regard to a reliable and careful connection of the layers of material at the micro-welds.

In an apparatus according to another embodiment, on the one hand one has the advantage that the current supply for the microwelding heads can be low, since it needs to provide solely the current respectively required by one microwelding head. Since, at a given instant, only one current path is produced, the various microwelding points are also welded equally well, whereas with a simultaneous supply of current to all the microwelding heads, different resistance values of the material in the vicinity of the micro-welds would lead to a different quality of the welds.

An apparatus according to another embodiment has a particularly simple mechanical construction and can also be used on materials, which are not suitable for microwelding on account of the choice of material and/or the mesh width.

With the development of the invention according to another embodiment, it is ensured that a finished coil is removed reliably and in a reproducible manner from the winding spindle equipped with gripping means. This facilitates a definite supply of the finished coil to a subsequent working station, for example a weighing station.

If, according to another embodiment, when stripping the finished coil by the stripping body, the winding spindle is driven at the same time in the opposite direction of rotation to the direction of rotation at the time of winding, then this facilitates the removal of the finished coil considerably.

For all-metal spring cushions produced from spring wire material coils, for achieving predetermined spring characteristics, it is important that the resilient mass lies exactly within predetermined limits. With the development of the invention according to another embodiment, it is ensured that by varying the length of the coiled material strip according to the fault signal produced by the weighing machine, the mass of the finished coil is kept constant irrespective of fluctuations in the width and in the density of the material.

In an apparatus according to another embodiment, it can be ensured that the end piece of the material strip, which after being cut from the continuous layer, lies between the cutting station and the winding spindle, produces a predetermined, possibly also uneven number of layers of material on the coil, and indeed for different external diameters of the coil.

The invention will be described in detail hereafter with reference to embodiments and referring to the drawings, in which.

Figure 18B:
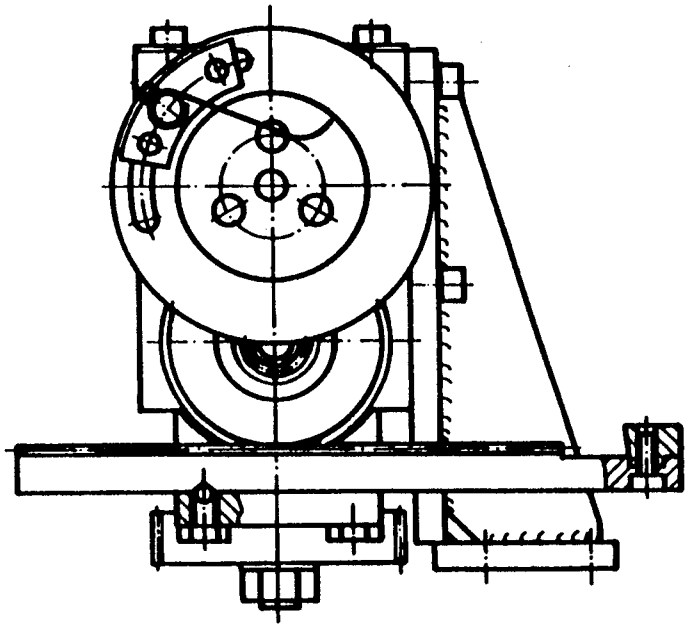
Figure 18A:
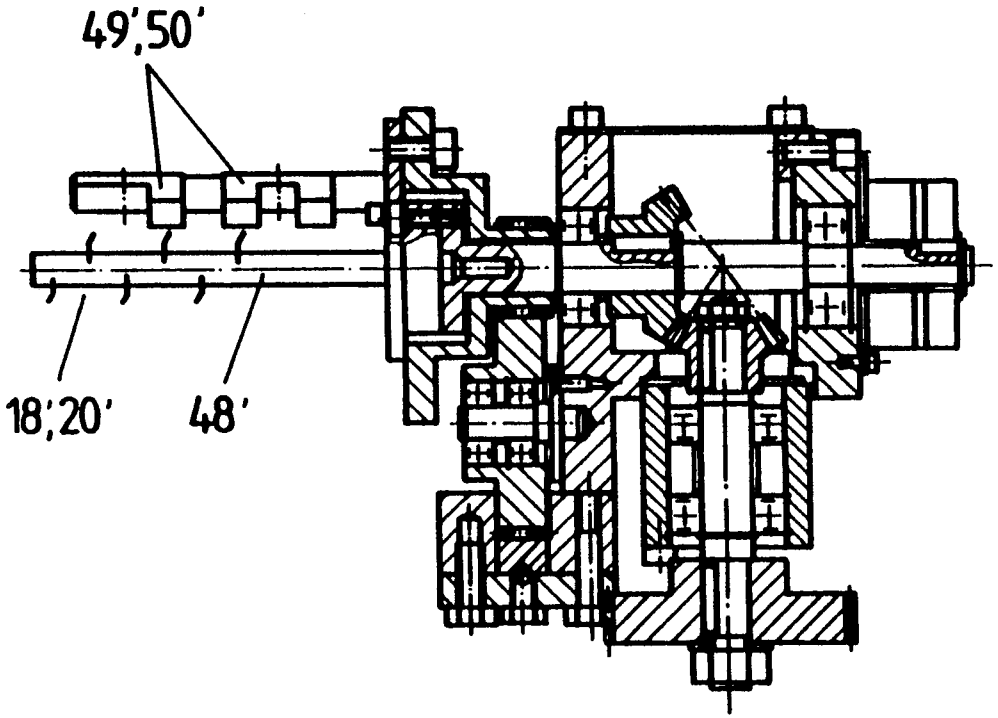
Figure 19B:
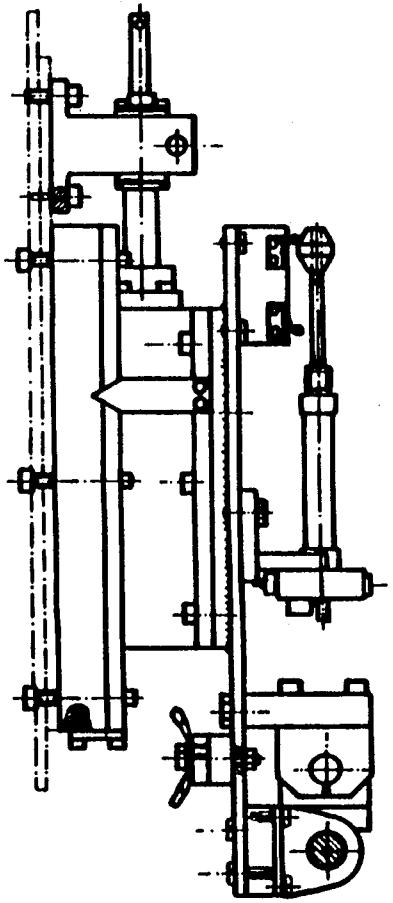
Figure 19A:
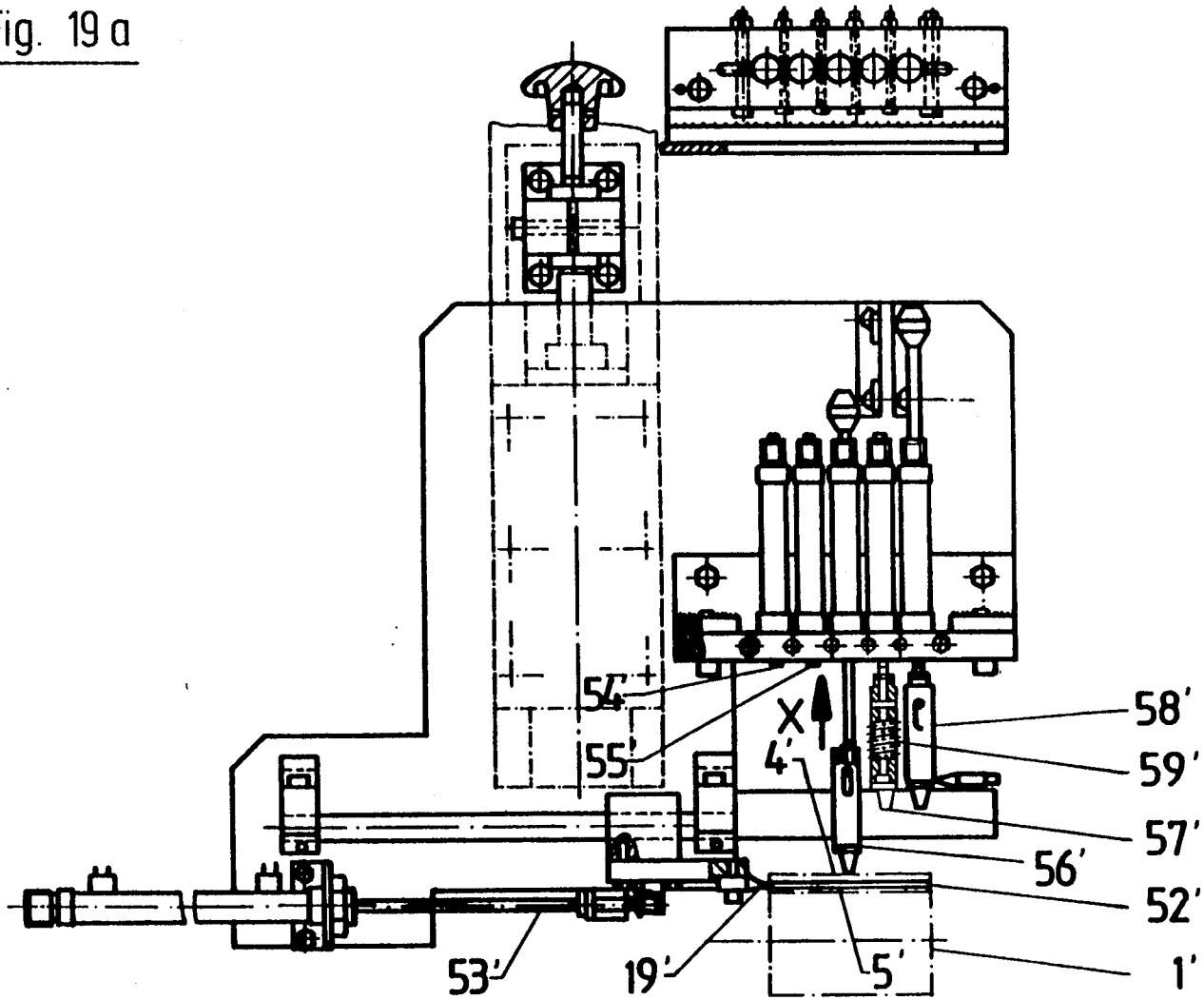

FIGS. 18*a* and 18*b* show a winding device of the apparatus in sectional (FIG. 18*a*), and end (FIG. 18*b*) view; and FIGS. 19*a* and 19*b* show a winding device of the apparatus in side (FIG. 19*a*), and end (FIG. 19*b*) view;

(FIGS. 13 to 19 correspond to FIGS. 1 to 12 as regards structural details).

In FIG. 1, the reference numeral 10 designates a material strip, which is supplied from the left by a conveyor device not shown in detail in FIG. 1. The material strip is produced by stretching a tube of spring wire, compressing the tube to form a double-layered strip and providing this strip with a waffle pattern (goffering). A material strip of this type is porous and flexible, however it has a certain inherent rigidity.

The supply of this strip is assisted by a guide plate 12, whereof the end simultaneously serves as a countercutter for an intermittently actuated cutter bar 14.

Figures 1A, 1B, 1C:
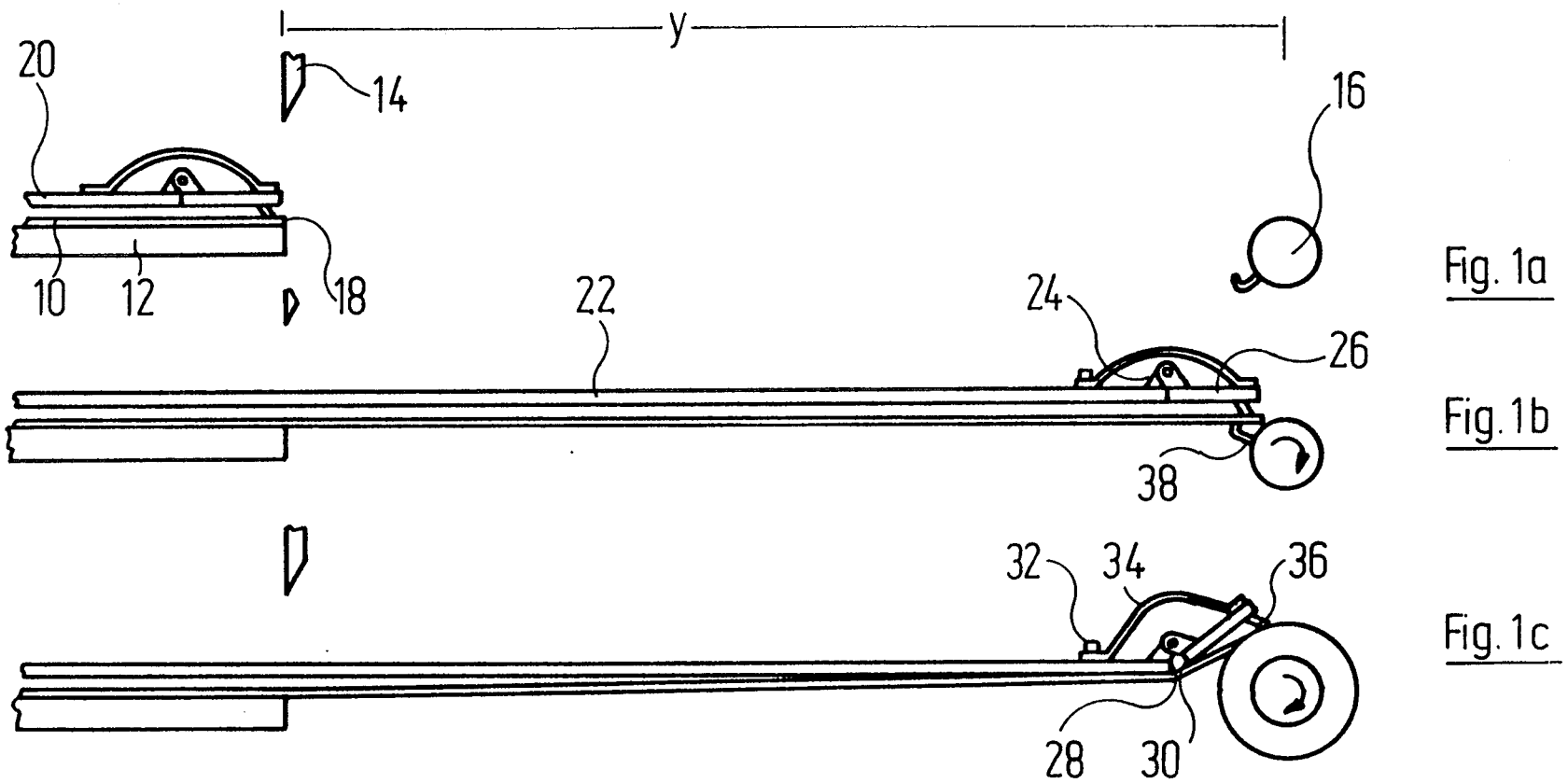
FIG. 1 shows in the partial Figures a)-h) various stages in the production of a spring steel coil.

FIG. 1*a* shows diagrammatically the operating state of a machine for producing coils, which contain a predetermined length of material strip, at the beginning of a winding cycle.

A winding spindle 16 located at a predetermined distance y in front of the end face of the guide plate 12 is empty, the front edge 18 of the material strip 10 produced by the last actuation of the cutter bar 14 aligns with the end face of the guide plate 12.

Provided at a small distance above the plane of the guide plate 12 is a conveyor arm designated generally by the reference numeral 20, which can be moved to the right and left in a plane lying parallel above the guide plate 12, by a drive to be described in more detail hereafter.

The conveyor arm 20 has a long, plate-shaped main section 22, which by way of a hinge 24 supports a front arm end section 26. As can be seen from FIG. 1, the hinge 24 is located above the plane of the main section 22 and the opposing end faces 28, 30 of the main section 22 and arm end section 26 thus form a stop, which defines the exactly aligning position of the arm end section 26.

Attached to the main section 22 by means of a screw 32 is a leaf spring 34, whereof the free end engages displaceably on the arm end section 26 and biases the latter resiliently into the position shown in FIG. 1*a*).

At the front end of the arm, the under side of the arm end section 26 is provided with gripping wires 36 extending obliquely forwards and downwards. Their length and the distance between the conveyor arm 20 and the guide plate 12 are coordinated with each other so that in the initial position illustrated in FIG. 1*a*), the gripping wires 36 necessarily engage in the material strip 10.

At the beginning of production of the coil, the conveyor arm 20 is moved towards the right in FIG. 1 and by its gripping wires 36 carries the front end of the material strip 10 to the winding spindle 16. FIG. 1*b*) shows the condition shortly before the front end of the material strip reaches the winding spindle 16. In this position, the end of the material strip is already located in the path of hook-like gripping wires 38, which are arranged to lie axially one behind the other along one generatrix of the winding spindle 16. The winding spindle 16 is simultaneously set in rotation in clockwise direction, and since the position of its axis of rotation is chosen so that the generatrix lies at the same height as the upper side of the guide plate 12, the material strip 10 runs up to the winding spindle tangentially.

As can be seen from the drawing, the obliquely bent end sections of the hook-shaped gripping wires 38 work into the front end of the material strip 10 and entrain the latter when the conveyor arm 20 is then stopped in the position shown in FIG. 1*b*. The inclined position of the gripping wires 36 now also facilitates sliding down of the material strip 10 from the gripping wires 36. The latter now bear under the pretension of the leaf spring 34 against the upper side of the material strip 10, when the latter is wound on the winding spindle 16.

Figures 1D, 1E, 1F:
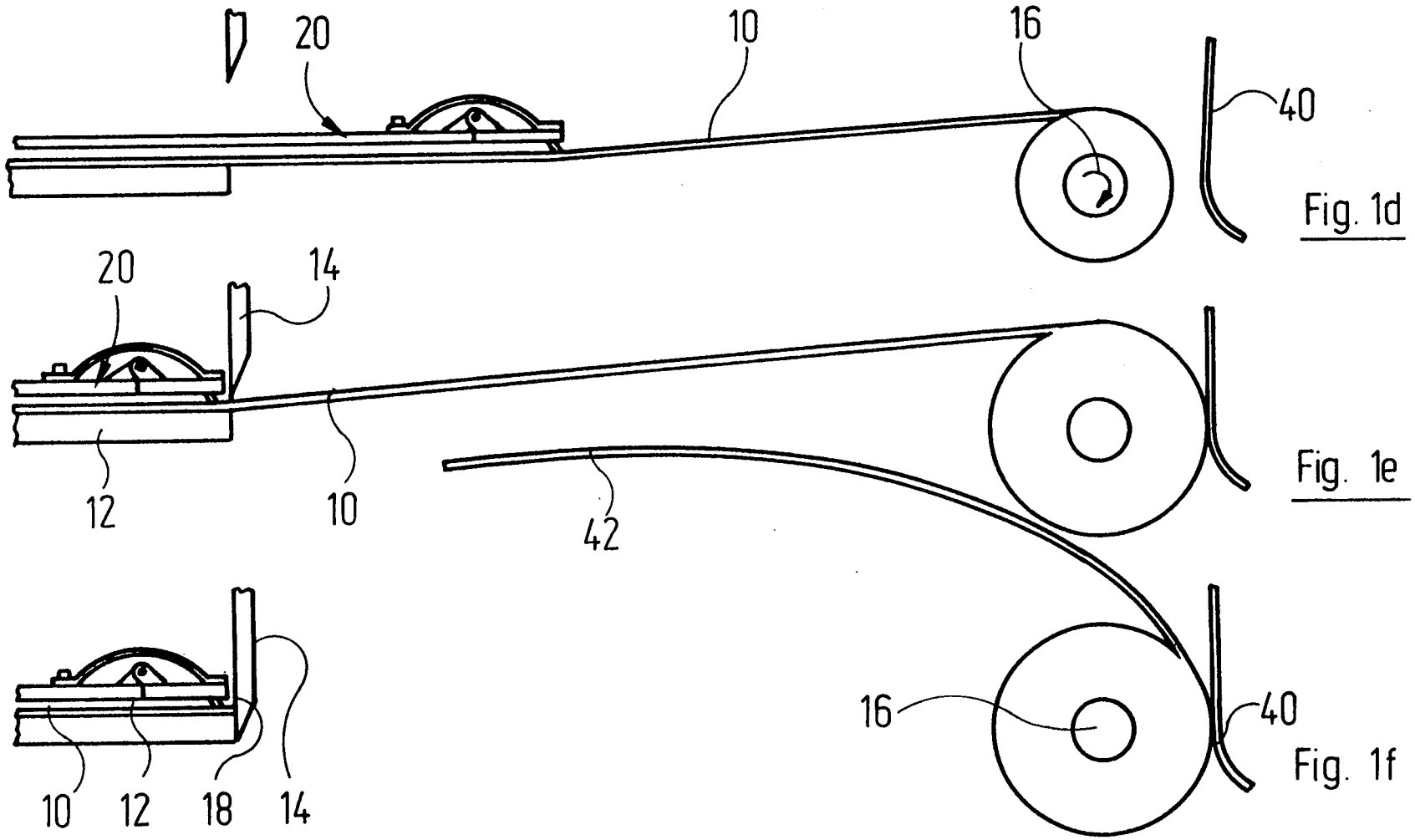

If the conveyor arm 20 is first of all left stationary for some time, until a few layers of the material strip 10 are wound on the winding spindle 16, then one achieves an operating state as illustrated in FIG. 1*c*). The arm end section 26 is now tilted upwards with further tensioning of the leaf spring 34 and serves as a resilient pressing blade, which ensures clean winding of the first layers on the winding spindle 16. The winding of further layers is then less critical and within the winding time necessary for finishing the coil, the conveyor arm 20 can be moved back again to its initial position, as shown in FIG. 1*d*). At the time of this return travel, the gripping wires 36 again slide on the upper side of the material strip 10 and stretch the latter and spread it out°

FIG. 1*d*) also shows diagrammatically a pressing spring designated generally by the reference numeral 40, which towards the end of the winding process presses the wound material against the coil.

FIG. 1*e*) shows the relationships after the complete return travel of the conveyor arm 20 to its initial position and directly before the cutting of the material strip 10 by the cutter bar 14.

FIG. 1*f* shows the relationships directly after the cutting of the material strip; it can be seen that after removing the tensile stress, on account of its flexibility and bending rigidity, one end section of the material strip designated by the reference numeral 42 adopts a spiral shape. The length of the end section 42 is measured so that it produces exactly a predetermined number of layers on the outside of the coil, in the embodiment considered here somewhat more than 1.25 layers.

Figure 1G:
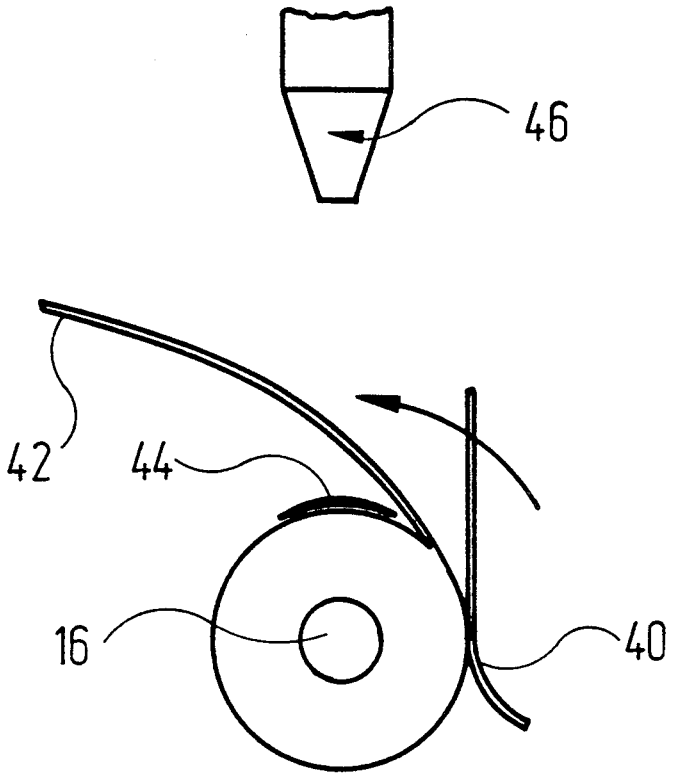
Figure 1H:
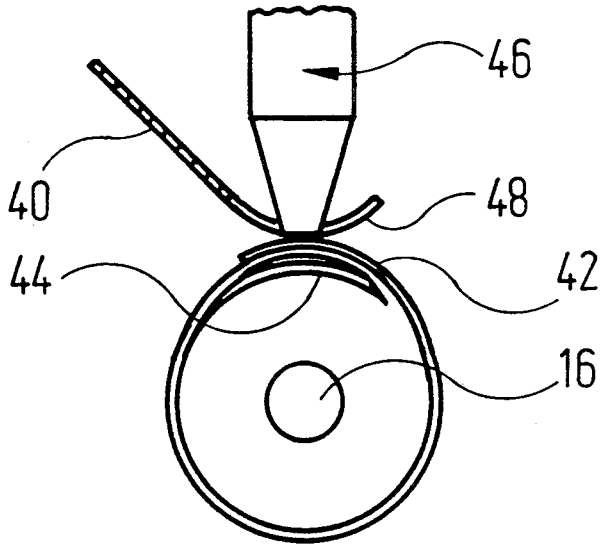

FIGS. 1*g*) and 1*h*) now show the last two end steps in the production of a securely closed material strip coil. These two steps are carried out in practice in a working station of the machine other than the winding illustrated in the partial FIGS. 1*a*) to 1*f*). For this purpose, the winding spindle 16 together with the coil supported by the latter is carried into this other working station, the fixing station. At this point, below the projecting end section 42, first of all an elongated, thin support member 44, curved in the transverse direction, is inserted in the axial direction below the end section 42. Then the pressing spring 40 is set in rotation in counterclockwise direction, in which case it then lays the end section 42 over the support body 44 and then winds it again by somewhat more than 360°. This state shown in FIG. 1*h*) thus comprises two layers of material strip lying one above the other over the support member 44. These layers can then be securely connected to each other by a fixing head 46 shown solely diagrammatically in FIG. 1, which may be a microwelding head for example, as will be described in more detail hereafter. The support member 44 produces the reaction force necessary for fixing the two outermost winding layers. If the fixing head is a welding head, the support member 44 may simultaneously represent the counter-electrode.

In order to be able to allow the pressing spring 40 to remain above the support member 44 even when fixing the outermost layers of the coil, the pressing spring 40 has a plurality of pressing fingers 48 lying axially one behind the other, and the fixing heads 46, which produce a plurality of fixing points perpendicularly to the plane of the drawing lying one behind the other along one generatrix, have access to the outermost layers of the coil through the gaps located between the pressing fingers 48.

Figure 2:
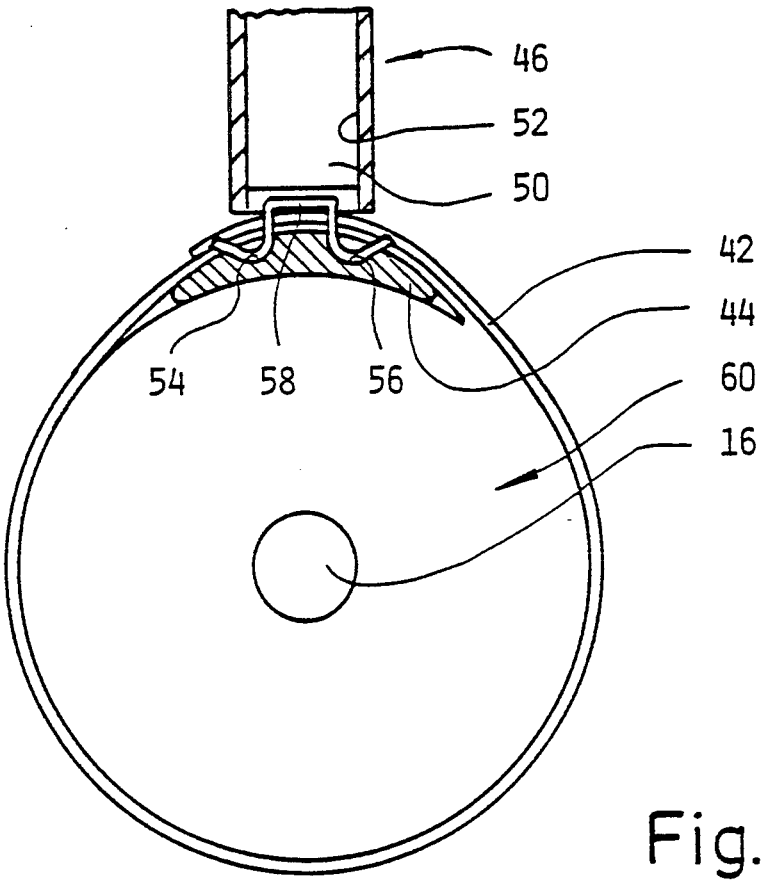
FIG. 2 is an enlarged section through a finished coil and a fixing head for the secure connection of the outermost layers of the coil.

FIG. 2 shows details of a fixing head 46, which connects the two layers of the fabric strip lying one above the other above the support body 44, by needles. The fixing head has a punch 50, which is able to move in the vertical direction in a guide 52 and separates staples from a staple bar (not shown in detail) and moves downwards. Provided in the upper side of the support member 44 are two deflecting grooves 54, 56, which cooperate with the free ends of the staples 58 and deflect the latter, above all somewhat more considerably than in the case of conventional needles. In this way, the ends of the sides of the staple pass through the two layers of material a second time. After the two layers of material have been securely connected to each other along a plurality of points by the fixing head 46 in succession or by a plurality of such fixing heads lying one behind the other at the same time, the support member 44 can be withdrawn axially from the coil 60, which is now finished and the coil can be withdrawn from the winding spindle 16, as will be described in more detail hereafter.

Figure 3:
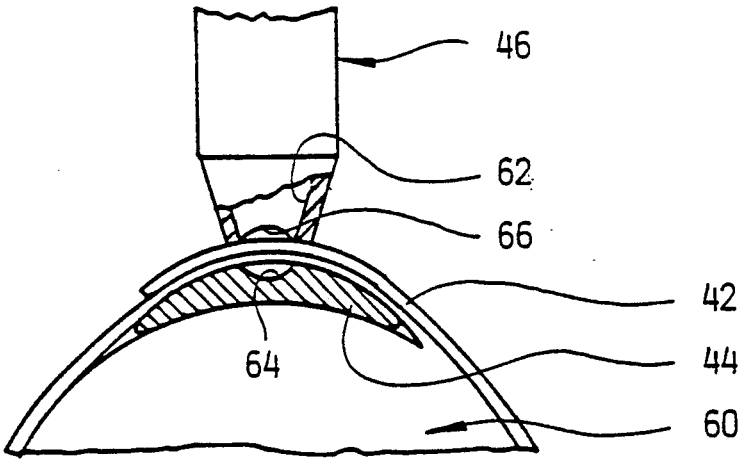
FIG. 3 is a view similar to FIG. 2, but in which a modified fixing head is shown.

FIG. 3 shows a modified fixing head, which is provided with a delivery channel 62 for hot-melt adhesive. The adhesive delivered by the fixing head 46 penetrates the two outermost layers of the material strip and passes into a curved groove 64, extending in the longitudinal direction, in the upper side of the support member 44. If one moves the fixing head 46, which is provided on the axial side faces with recesses 66 of the delivery channel 62, in the direction perpendicular to the plane of FIG. 3, then one obtains as a whole an adhesive connection similar to a welded seam, which has a good mechanical load-carrying capacity. The removal of the finished coil 60 takes place in a manner similar to that described above with reference to FIG. 2.

Now, details of a winding unit are described with reference to FIG. 4, which unit brings about both the winding of the main length as well as of the end section 42 of the material strip, to which mention was made above with reference to FIGS. 1*a*)–1*f*) or 1*g*) and 1*h*).

The winding spindle 16 has an attacb/nent flange 68, which is located by means of screws 70 on a shaft flange 72. The latter is formed on a shaft 74, which is mounted by way of bearings 76, 78 in a housing 80. Between the bearings 76, 78, the shaft 74 supports a bevel gear 82, which meshes with a smaller bevel gear 84. The latter is seated on the end of a vertical drive shaft 86, which is mounted by means of bearings 88, 90 in the housing 80 and at the lower end supports a drive gear 92. The latter can be brought into engagement with the pinion of a drive motor (not shown in FIG. 4), which is provided in the winding station of the coil production machine shown generally in FIG. 9.

Figure 4:
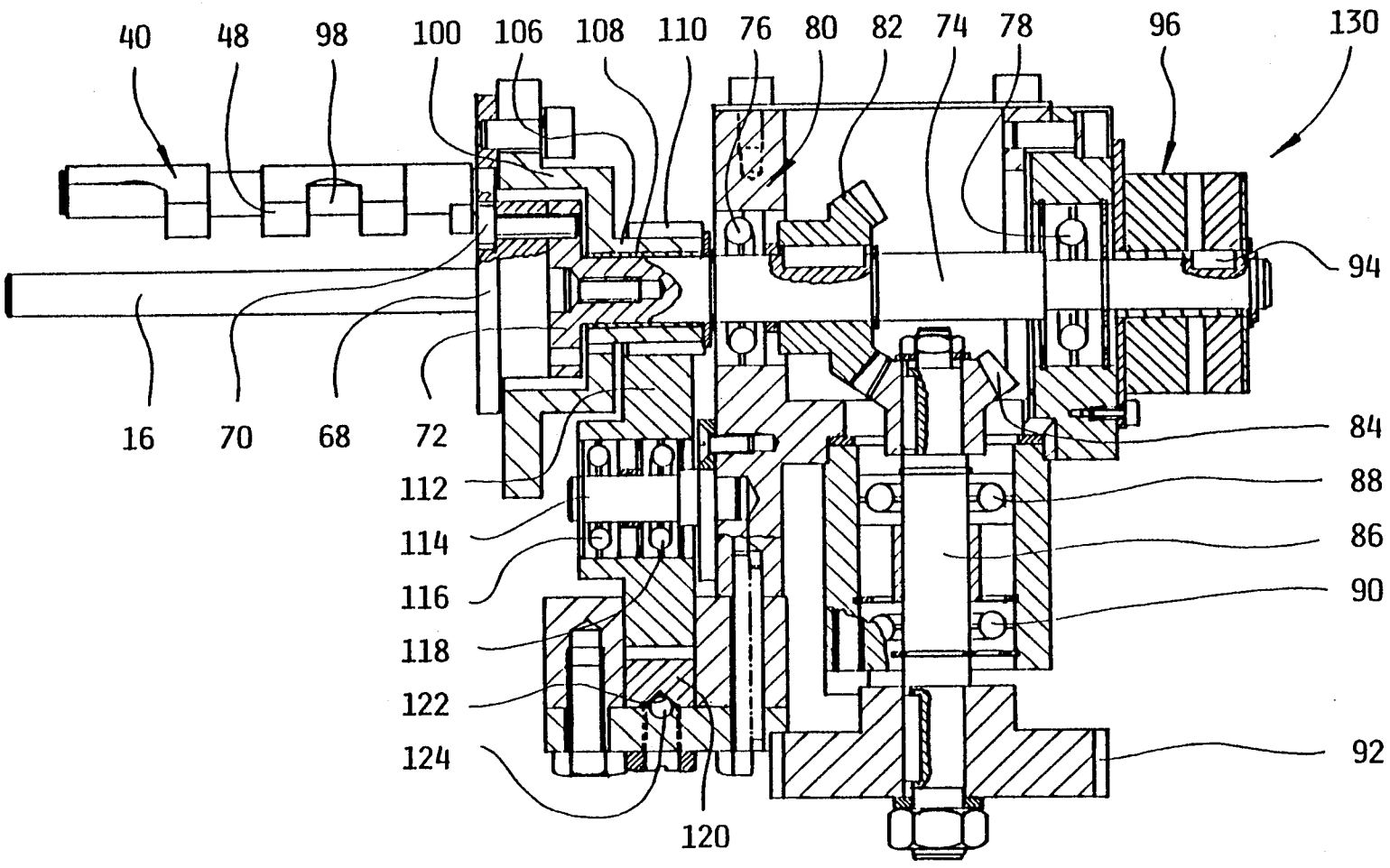
FIG. 4 is an axial section through a winding unit of a machine for producing a closed spring steel coil.

The end of the shaft 74 located on the right in FIG. 4 cooperates by way of a wedge 94 with an electromagnetically operated brake 96.

The pressing spring 40 is seated on a rod 98, which is mounted to move in the peripheral direction on a cup-shaped drive member 100 by means of a mounting plate 102 and screws 104 in an oblong hole. The drive member 100 has a sleeve-like hub section 106, which is mounted on the shaft 74 with the interposition of a sliding bearing bush 108.

Fitted in a non-rotary manner on the outside of the hub section 106 is a gear 110, which meshes with a free running gear 112 of larger diameter. The gear 112 is mounted on the housing 80 by way of a short, stationary shaft 114 and bearings 116, 118.

The gear 112 meshes with a rack 120, which is guided to slide in the horizontal direction in the housing 80 and is provided on its under side with a locking groove 120. The latter cooperates with an elastically biased locking ball 122 and thus defines exactly the position of the pressing spring 40, in which its innermost section lies substantially above the highest point of the finished coil.

Figure 5:
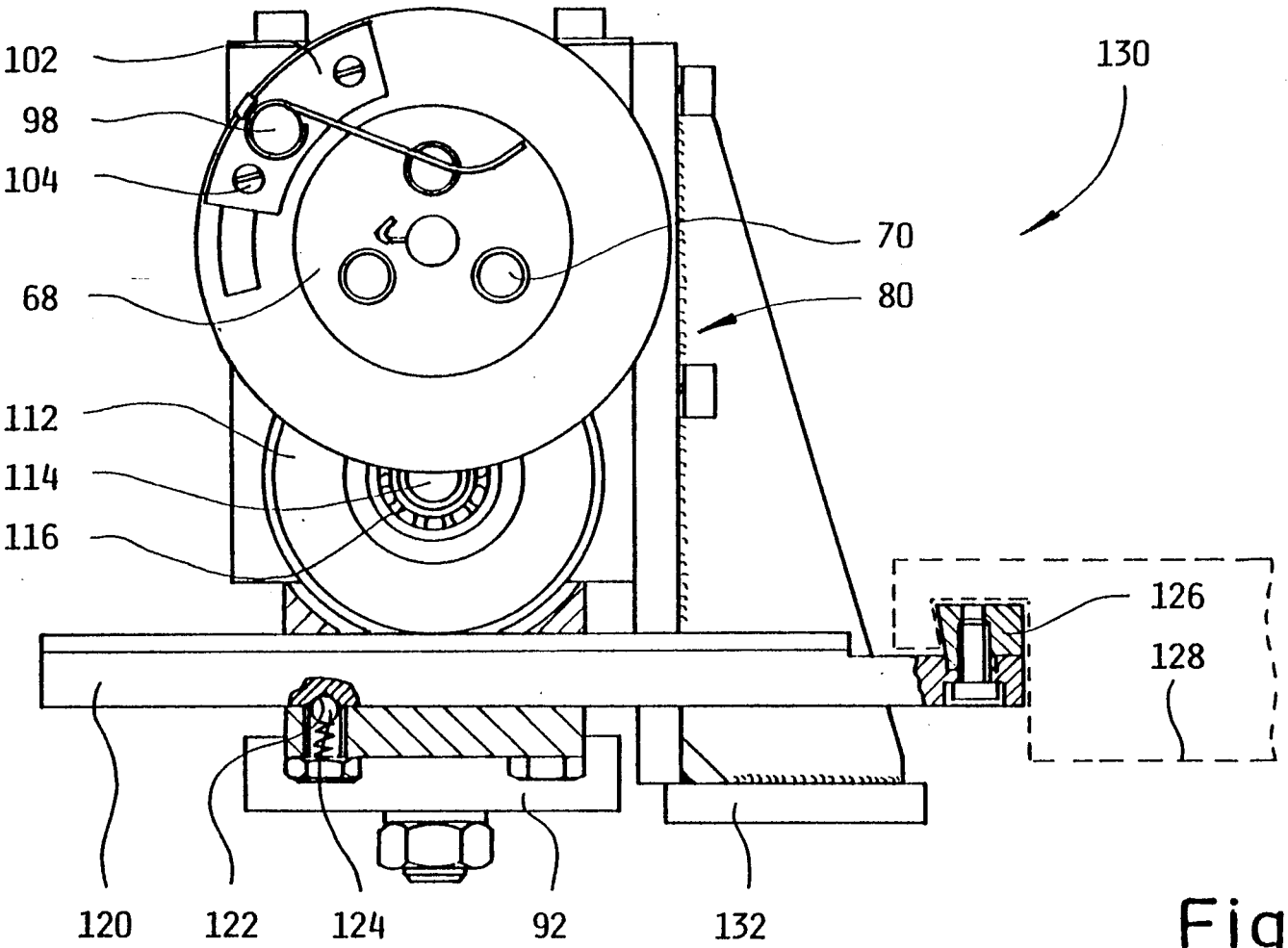
FIG. 5 is a plan view of the front end of the winding unit shown in FIG. 4.

The end of the rack 120 located on the right in FIG. 5 supports a coupling head 126, which can be brought into and out of engagement with a counter-coupling member 128 by moving in a direction perpendicular to the plane of the drawing of FIG. 5, which counter-coupling member 128 is located at the end of the piston rod of a working cylinder not shown in FIG. 5, which cylinder serves for rotating the pressing spring 40 about the axis of the winding spindle 16.

A lower attachment flange 132 of the housing 80 serves for the attachment of the above-described winding unit, designated generally by the reference numeral 130, to conveying means for moving through various working stations, for example a turntable.

Figure 6:
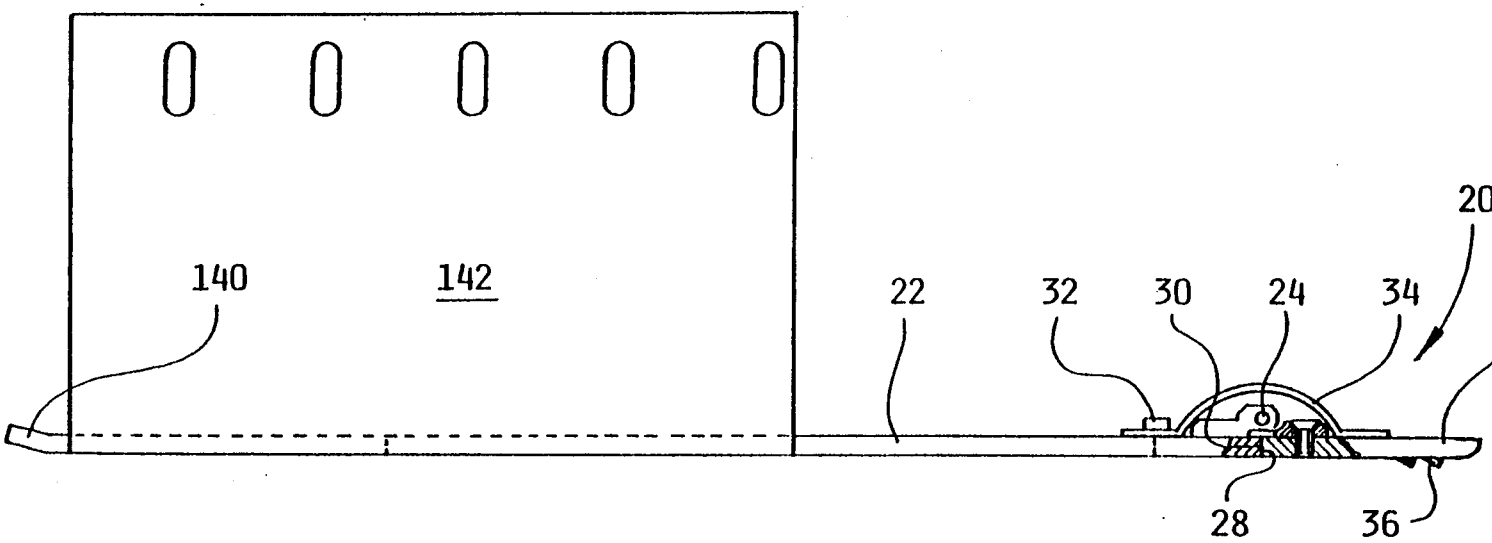
FIG. 6 is a side view of a conveyor arm of a machine for producing a closed spring steel coil.
Figure 7:
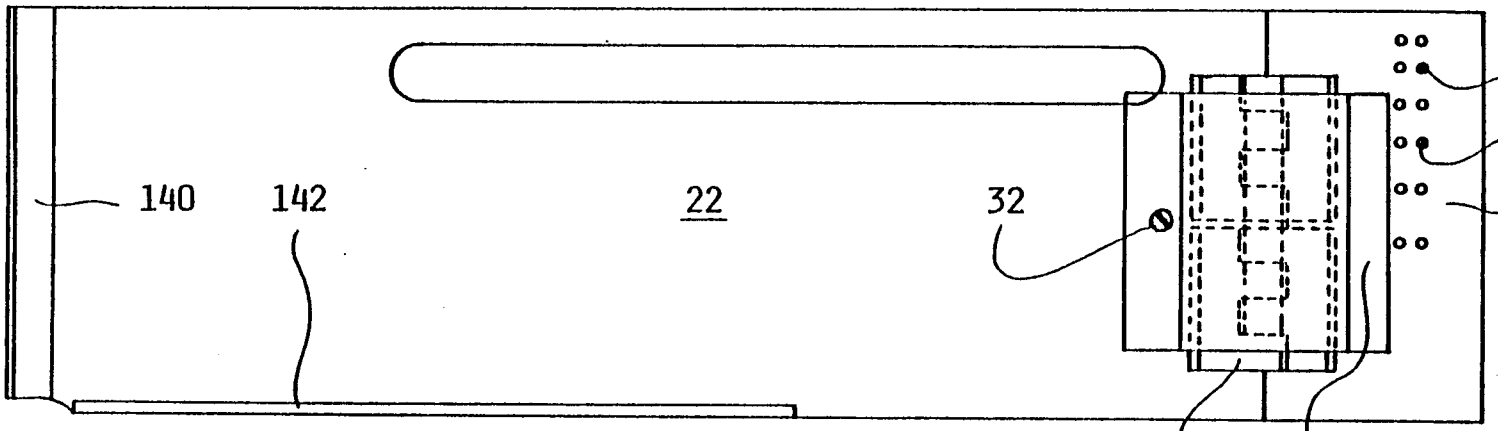
FIG. 7 is a plan view of the conveyor arm according to FIG. 6.

FIGS. 6 and 7 show details of the conveyor arm 20 and of the arrangement of gripping wires 36 on the arm end section 26, to an enlarged scale. The gripping wires 36 are arranged in two rows, which in a practical embodiment are 5 mm apart. The spacing of the gripping wires 36 within one row increases in a downwards direction in FIG. 7, since for the reliable gripping of wide material strips, one requires more gripping wires not in proportion to the width of the strip.

Figure 8:
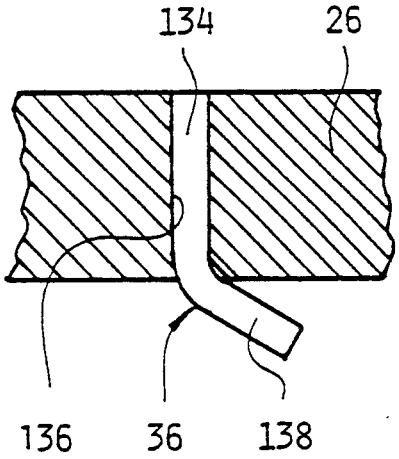
FIG. 8 is a section through a front portion of the conveyor arm according to FIG. 6, to an enlarged scale, in which gripping wires for the entrainment of the spring steel material are shown in detail.

As can be seen from FIG. 8, the gripping wires 36 each have a vertical attachment section 134, which is inserted in an associated bore 136 of the arm end section 26 with soft solder. A gripping section 138 of the gripping wire 36, projecting beyond the under side of the arm end section 26, is bent at an angle of 30° with respect to the under side of the arm end section 26. In a practical embodiment, in which the gripping wire 36 is made from 1 mm spring steel wire, the length of the gripping section 138 amounts to 3.5 mm.

As can be seen from FIG. 6, the main section 22 of the conveyor arm 20 has an upwardly bent, rear end 140. The latter facilitates the relative movement between the conveyor arm 20 and material strip 10, when the latter is pulled below the stationary conveyor arm or the conveyor arm is moved from the front position adjacent the winding spindle 16 above the material strip 10 to the rear position adjacent the cutter bar 14.

The main section 22 of the conveyor arm 20 also has a laterally raised attachment section 142, which is connected to the output part of a controllable linear motor, as will be described in more detail hereafter.

Figure 9:
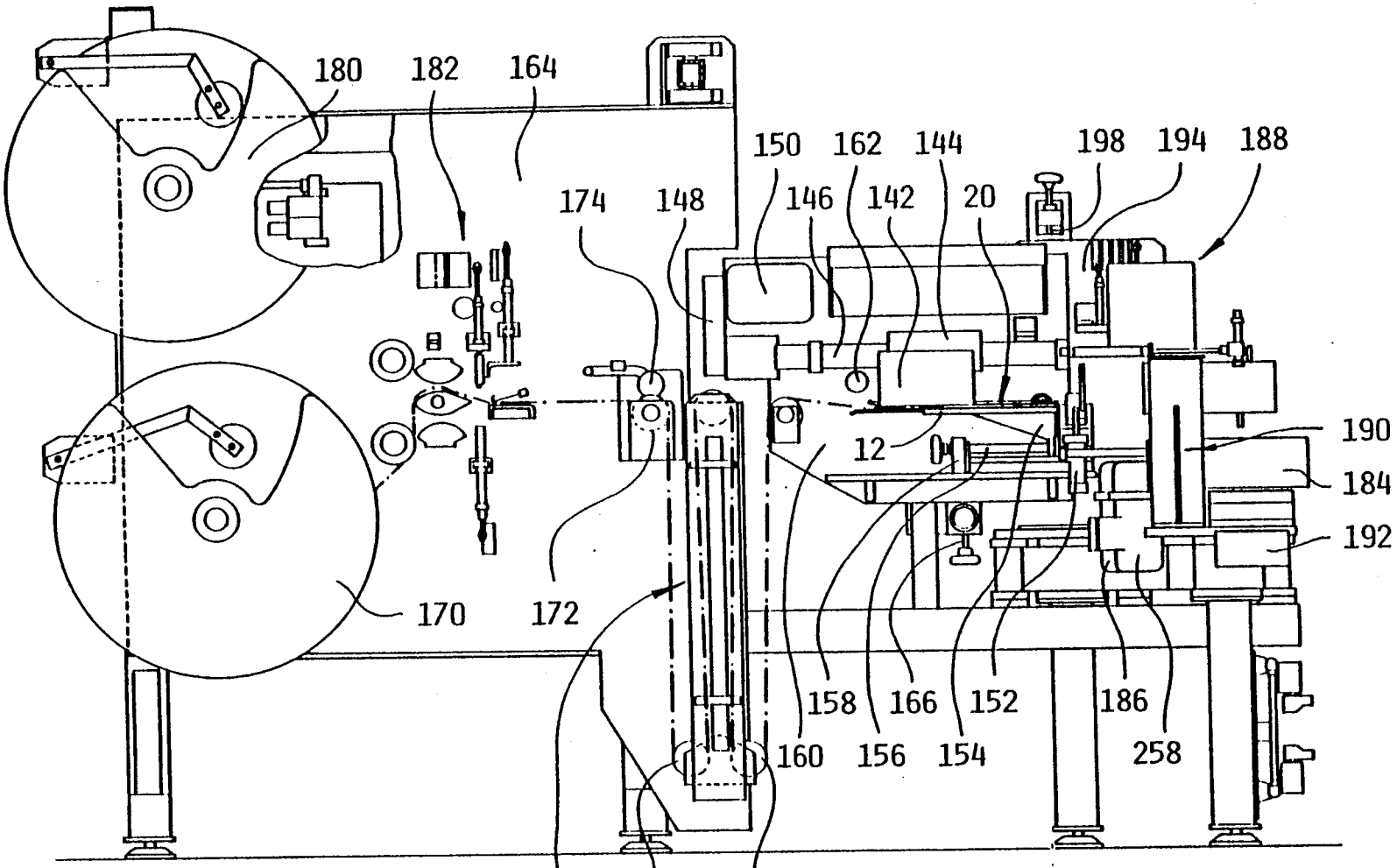
FIG. 9 is a diagrammatic side view of a machine for producing a closed spring steel coil.

In the general view of a machine for producing spring steel material coils shown in FIG. 9, a drive carriage 144 is shown, on which the attachment section 142 of the conveyor arm 20 is located. The drive carriage 144 travels on a threaded spindle 146, which can be rotated in both directions of rotation by way of a toothed belt 148 by an electric motor 150. The actual position of the driving carriage 144 is measured by a linear position indicator (not shown in detail) and the electric motor 150 is energized by a control circuit (likewise not shown in detail), so that the actual position corresponds to a reference position determined by a central control unit.

The guide plate 12 and the cutter bar 14 actuated by a compressed air cylinder 152 are seated on an auxiliary frame 154, which can be moved in the conveying direction of the material strip 10 by means of a hand-operated threaded spindle 156. Bearing bosses 158 for the threaded spindle 156 are seated on a second auxiliary frame 160, which is arranged to tilt by way of a hinge pin 162 on a main frame 164 of the machine. Serving for adjusting the inclination of the second auxiliary frame 160 is a further, hand-operated threaded spindle 166, which is mounted on the main frame 164 and whereof the end engages on the second auxiliary frame 160. The inclination of the auxiliary frame 160 is adjusted so that the plane of movement of the conveyor arm 20 extends substantially tangentially to the outer surface of the winding spindle 16 respectively used.

FIG. 9 also shows in the center, a storage unit designated generally by the reference numeral 168, which at the time of continuous withdrawal of the material strip 10 from a supply roll 170 produces equalization of the strip movement taking place intermittently and quickly, at the time of winding. The withdrawal of the material strip 10 from the storage roll 170 at a continuous feed speed is taken care of by a drive roller 172 provided with prongs, which cooperates with a rubber counter-roller 174. The temporary storage of the material strip in the storage unit 168 is taken care of by two compensating rollers 176, 178, which cooperate in known manner by way of a light barrier with a control unit for an electric motor (not shown), which rotates the drive roller 172.

Located above a storage roller 170, which has just been unwound, is a reserve storage roller 180 and an automatic splicing station 182 preceding the storage unit 168 automatically connects the beginning of the reserve supply roller to the end of the material strip of the previously unwound storage roller, in order to facilitate a continuous operation of the machine.

In the right-hand part of FIG. 9, a turntable 184 is shown diagrammatically, which supports four winding units 130 with an angular spacing of 90°, as was mentioned above with reference to FIGS. 5 and 6. FIG. 9 also shows an electric motor 186, whereof the output pinion in the winding station meshes with the drive gear 92 of a winding unit 130 and can thus drive the winding spindle 16. FIG. 9 also shows diagrammatically a welding station 188, by which the two outermost layers of a coil of material strip are connected securely to each other by microwelds, furthermore an ejection station 190 is shown. Located below the ejection station 190 is an electronic weighing machine 192, onto which the finished coils drop after being removed from a winding spindle 16. From the winding machine 192, the finished coils are then slid downwards to the right or left, depending on whether their weight lies within the prescribed weight range or outside this range.

Figure 10:
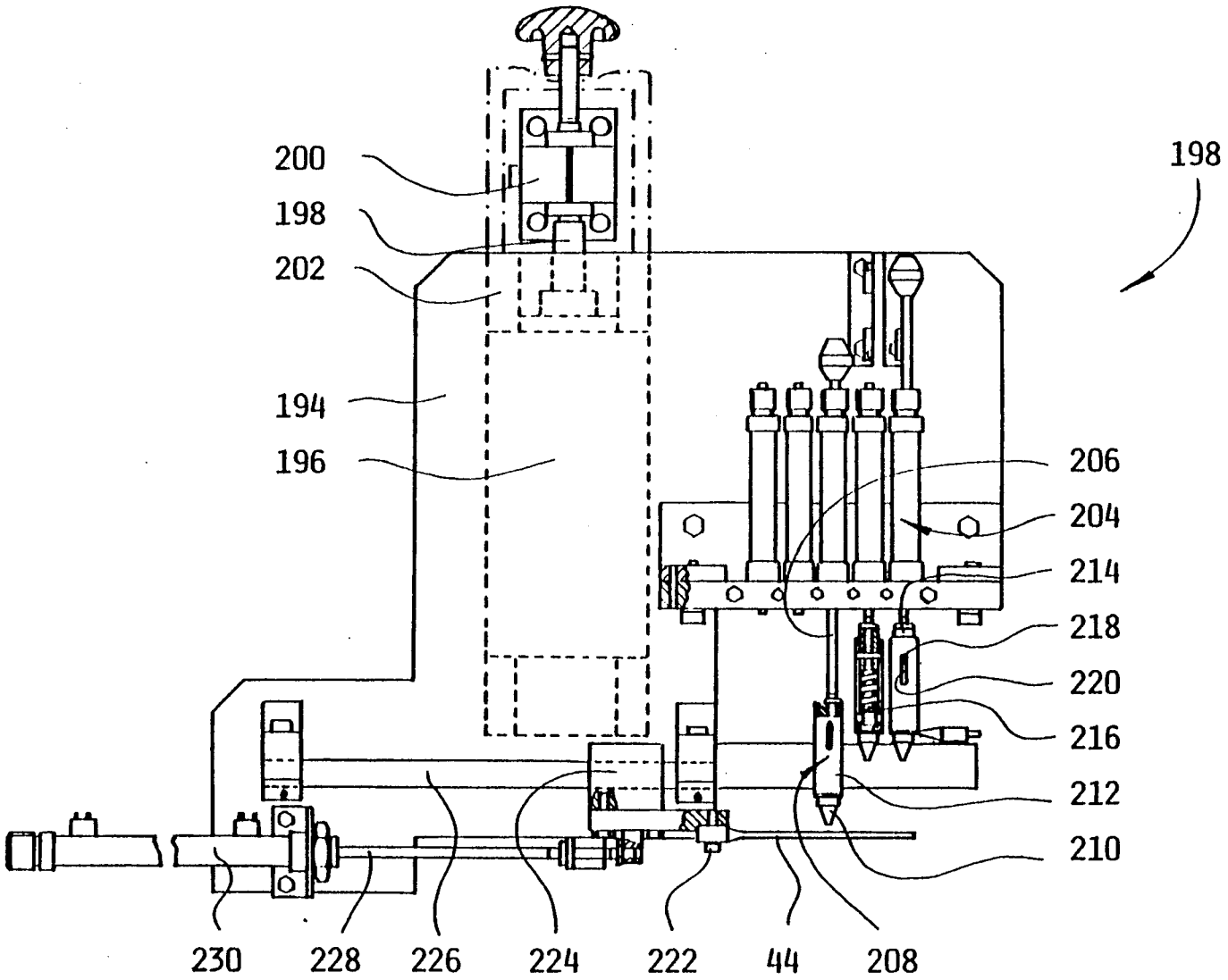
FIG. 10 is a view of the front end of a welding station of the shown in FIG. 9, to an enlarged scale.

FIG. 10 shows details of the welding station 182. A station frame 194 is seated on a carriage 196, which is able to move in the vertical direction by means of a spindle 198. The bearing 200 of the threaded spindle 198 is supported on the main frame 164 of the machine and for guiding the station frame 194 the carriage 196 travels in a vertical guide 202, which is likewise connected to the main frame 164.

The station frame 194 supports five compressed air cylinders 204 lying one beside the other, whereof the piston rods 206 each support a microwelding head designated generally by the reference numeral 208. The welding heads 208 each have a frustoconical electrode 210, which is inserted securely in a sleeve part 212. The latter engages over a head part 214, which is connected to the piston rod 206. The electrode 210 is biased resiliently downwards in the drawing by a spring 216, whereby a pin 218 provided in the head part 214 together with slots 220 provided in the sleeve part 212 limits the spring displacement.

Below the microwelding heads 208, the thin support member 44 is shown in its fully extended working position engaging below the outer layers of the coil. The support member 44 is attached by way of screws 222 to a carriage 224, which travels on guide rails 226, which are provided on the station frame 194. Located on the carriage 224 is the end of the piston rod 228 of a double-acting compressed air cylinder 230, which serves for moving the support member 44 between the working position shown in FIG. 10 and an inoperative position located on the left in FIG. 10.

For welding the outer layers of the material strip, the microwelding heads 208 are moved in succession individually towards the support member 44, so that only a single path is provided for the welding current, which path leads across the respective welding point. Thus, even those microwelds, in which originally poor electrical conductivity existed, for example as a result of oil residues on the material strip or the like, are produced so that they are able to carry a load.

Figure 11:
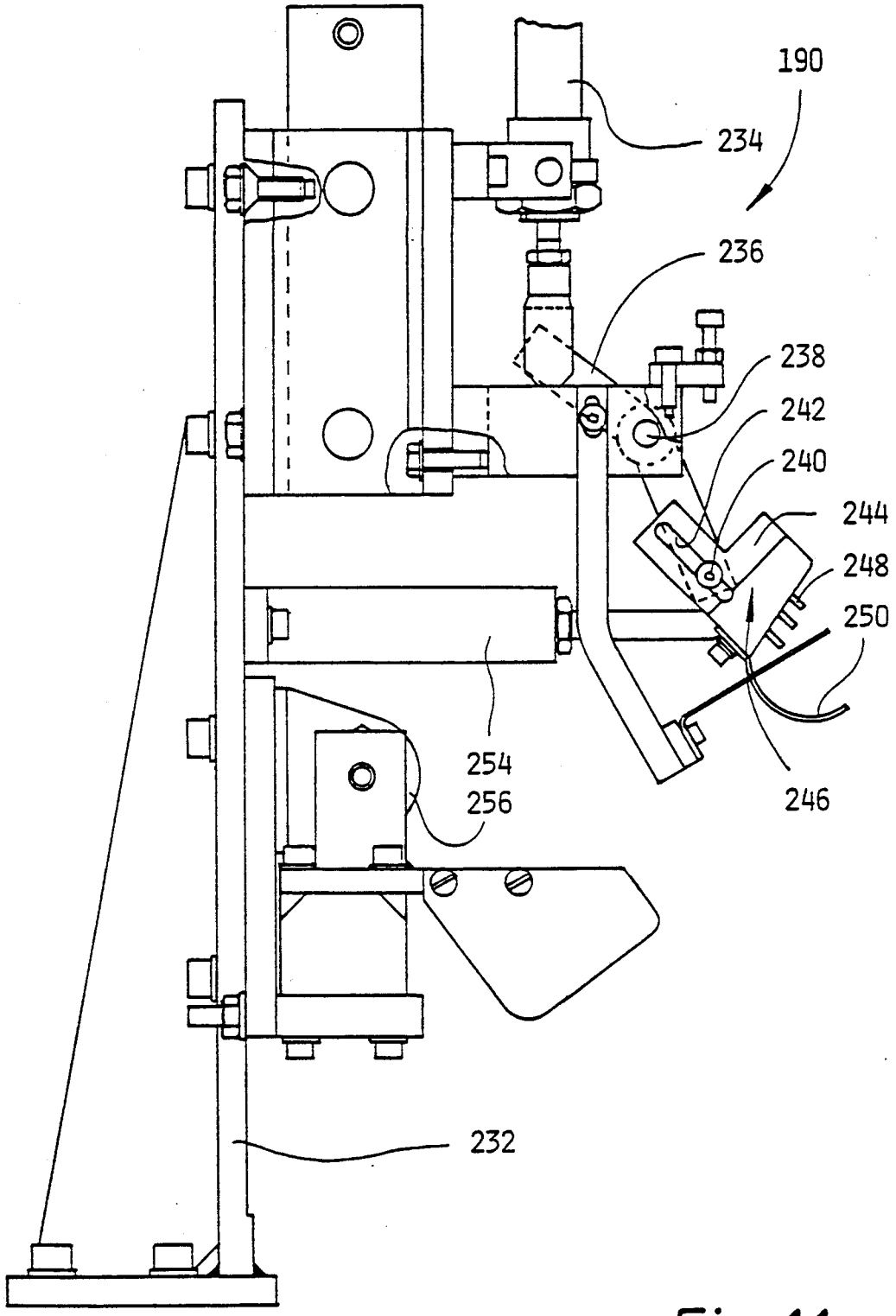
FIG. 11 is a plan view of an ejection station of the machine showw in FIG. 9, to an enlarged scale.

FIG. 11 shows details of the ejection station 190. A station frame designated generally by the reference numeral 232 supports an upper, vertical compressed air cylinder 234, which acts on an angle lever 236, which is mounted by way of a tilting bolt 238 on the station frame 232. The driving end of the angle lever 236 engages by a drive pinion 240 in an elongated slot 242, which is provided in a projection 244 of a stripping member designated generally by the reference numeral 246. The latter is provided on its obliquely inclined under side with prongs, which can be pushed into a finished coil of material strip. A collecting groove 250 in the shape of a circular arc is provided below the prongs 248 on the stripping member 246.

The rounded end of the piston rod 252 of a further compressed air cylinder 254 acts on the stripping member 246. Due to an-appropriate control of the two compressed air cylinders 234 and 254, one can thus move the stripping member 246 in FIG. 11 towards the right and left or tilt it about an axis perpendicular to the plane of the drawing of FIG. 11. Due to these two movements, the stripping member 246 with its prongs can be moved towards a finished coil of material strip and then if the entire previously described mechanism is moved by the supply of pressure to a further compressed air cylinder 256 in the direction perpendicular to the plane of the drawing of FIG. 11, a coil of material strip is withdrawn axially from a winding spindle, whereof the axis would likewise be perpendicular to the plane of the drawing in Figure 11. In order to facilitate this removal, in the ejection station 190, an electric motor 258 is likewise provided (see FIG. 9), whereof the output pinion in this station is in engagement with the drive gear 92 of a winding unit. However, this electric motor is set in rotation in the opposite direction to the electric motor of the winding station, so that the obliquely inclined end sections of the hook-shaped gripping wires 38 provided on the winding spindle 16 are moved out of the inner surface of the coil.

Figure 12:
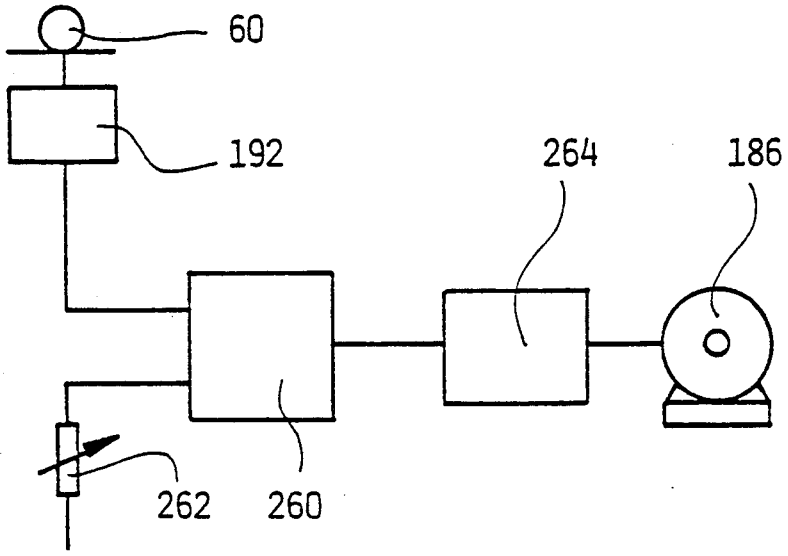
FIG. 12 is a block circuit diagram of a control circuit of the machine shown in FIG. 9, by which the mass of the spring steel coil is kept constant; and also

FIG. 12 shows diagrammatically the electronic weighing machine 192 together with a coil 60 lying on its scale. The output signal from the weighing machine 192 is sent to the first input of a comparator 260, whereof the second input receives a signal associated with the desired weight of the coil 60, which signal is determined for example by adjusting a potentiometer 262. The fault signal present at the output of the comparator 260 is sent to a controllable monostable trigger circuit 264, whereof the pulse width determines the duration for which the electric motor 186 provided in the winding station operates. In this way one obtains a total weight of the coil, which is independent of fluctuations of width and variations of density of the material strip.

Figure 13:
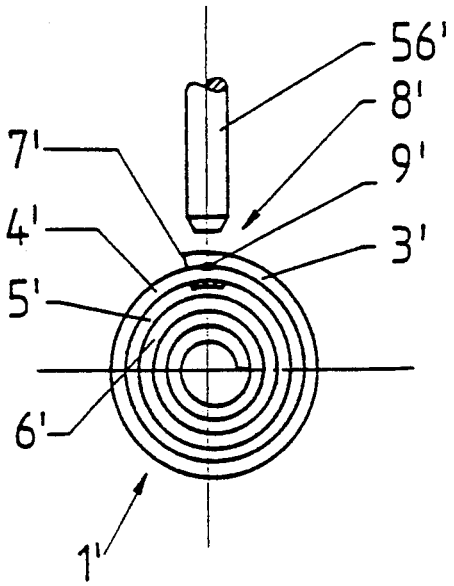
FIG. 13 is a view in the axial direction of a spring cushion basic member.
Figure 14:
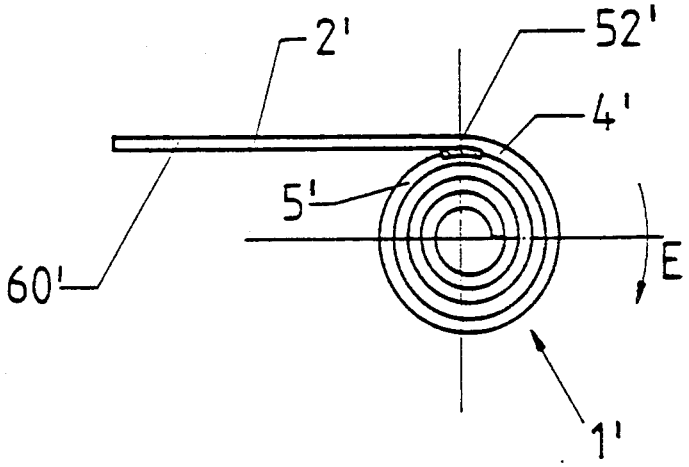
FIG. 14 shows a preliminary stage to the view corresponding to FIG. 1.

FIG. 13 shows a spring cushion basic member 1', which has a circular cylindrical shape and consists of a material 2' having loops and made from steel wire. The material 2' has an endless cross-section or is constructed in the manner of a tube and is wound in a spiral manner, the layers 3' to 6' being in contact with each other. An end piece 7' on the outer periphery 8' of the spring cushion basic member 1' is connected by welding to the adjacent layer 4'. Expressed in other words, the layers 3' and 4' are connected to each other, the welded connection being illustrated by several welds 9' which are spaced apart.

Figure 15:
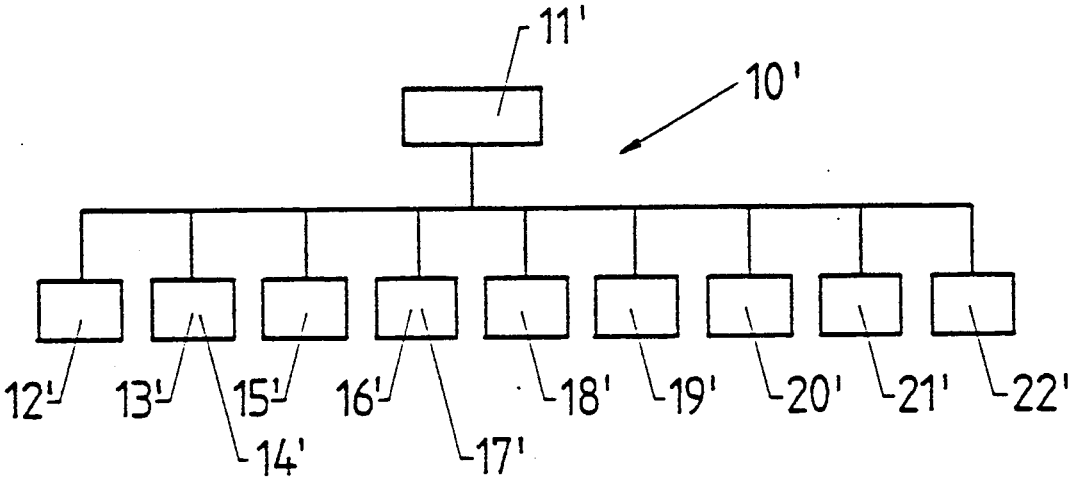
FIG. 15 is a block circuit diagram of an apparatus for producing spring cushion basic members.

FIG. 15 shows diagrammatically an apparatus for producing the basic member. It comprises a computer 11', which is connected to the following devices: a rolling device 12', a connecting device 13' with a first welding device 14', a storage device 15', a measuring device 16' with a cutting device 17', a first winding device 18', an electrode device 19', a second winding device 20', a second welding device 21' and a weighing device 22'. The possibility also exists of connecting only part of the preceding devices to the computer 11'.

Figure 16:
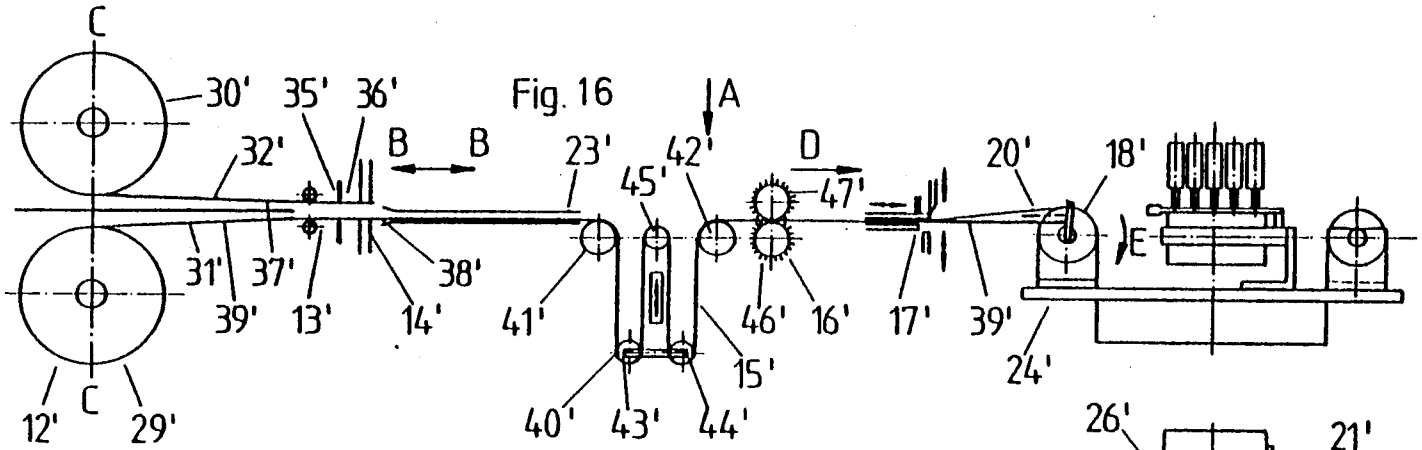
FIG. 16 is a side view of the apparatus for producing spring cushion basic members.
Figure 17:
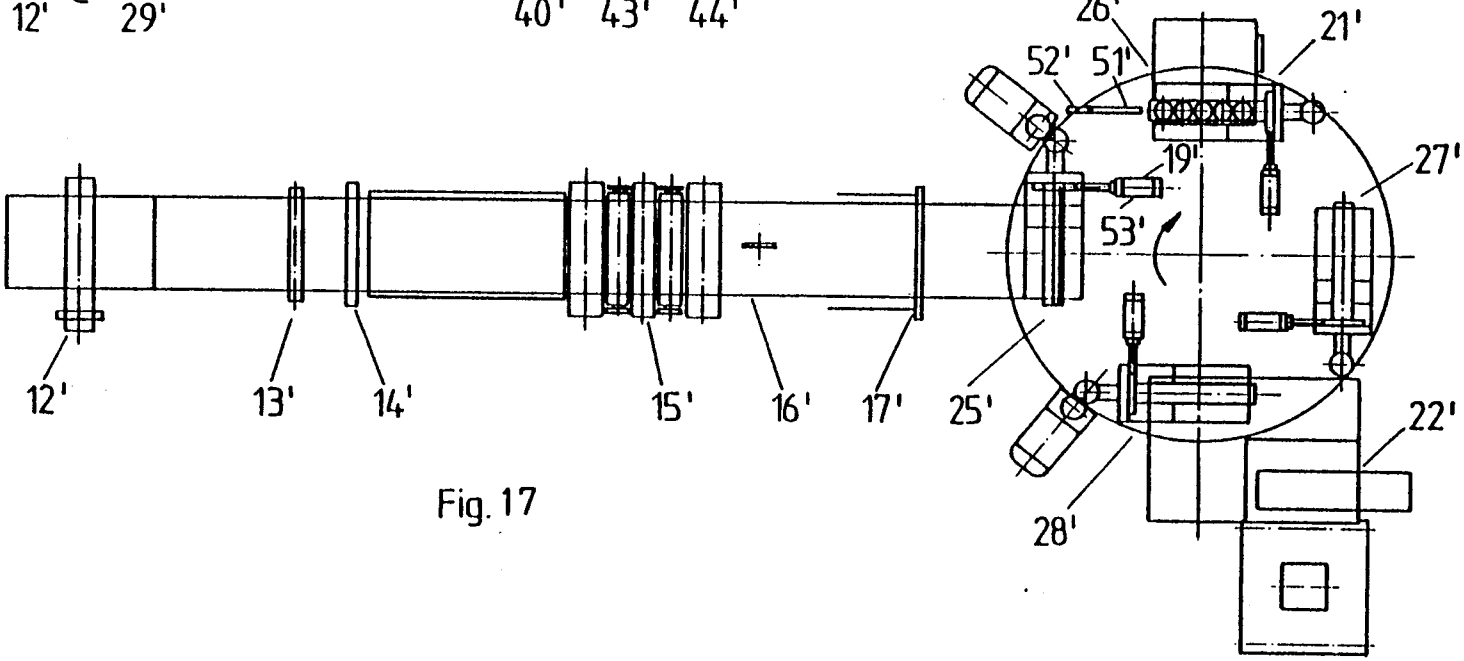
FIG. 17 is a view in the direction of arrow A of FIG. 16.

According to FIG. 16, the rolling device 12', the connecting device 13' with the welding device 14', the storage device 15' and the measuring device 16' with the cutting device 17' of the device 10' are located on a conveyor belt 23', which adjoins a round table 24' radially. The round table 24' supports the first and second winding device 18', 20', the electrode device 19' and the second welding device 21'. The weighing device 22' follows the round table 24', which comprises four stations 25', 26', 27' and 28' namely a winding station, a welding station, a rest station, and an eject station, respectively.

The rolling device 12' (FIG. 16) is formed by two rollers 29', 30' lying one above the other, whereof the tangential material outlets 31', 32' extend adjacent to each other in the direction B—B of the conveyor belt 23'. The centers 33', 34' of the rollers 29', 30' lie on a common vertical plane C—C.

The connecting device 13' is provided with a sensor 35', which on the one hand fixes a rear end piece, for example 36' of the material 37', which is withdrawn from the roller 30', in the region of the welding device 14'; the roller 30' is consequently unwound to the full extent. On the other hand, the sensor 35' ensures that a front end piece 38' of the material 39' of the roller 29' is conveyed to the welding device 14'. The two end pieces 36' and 38' are aligned in an overlapping manner and connected to each other by the welding device 14', which comprises several spot welding electrodes.

The reference numeral 40' designates the storage device 15', which is constructed in the manner of compensating rollers and comprises a first and a second motor 41', 42' of electrical construction and deflection rollers 43', 44' and 45'.

The measuring device 16', which lies behind the second motor 42' seen in the direction of travel D of the belt, has two measuring rollers 46', 47' located on both sides of the material 39'. Located between the measuring rollers 46', 47' and the first and second winding device 18', 20' is the cutting device 17', which operates depending on the measuring device 16'.

The first winding device 18' (FIG. 18), which is located on the round table 24' like the second winding device 20', comprises a winding spindle 48', which may be provided for example with hooks 49', which act as entrainment members in the material winding direction E, but can be constructed to release the material in the opposite direction. The second winding device 20' comprises a comb 50' for the material 39', which can be rotated by means of a transmission 51' about the winding spindle 48' in opposition to the material winding direction E.

The electrode device 19' comprises an electrode 52', which is arranged transversely to the winding spindle 48' and can be actuated by means of a pneumatic control member 53' (FIGS. 5' and 7'); it can be introduced between two layers 4', 5' of the spring cushion basic member.

The second welding device 21' (FIG. 19) comprises several spot welding electrodes 54', 55', 56', 57', 58', which are able to move perpendicularly towards the electrode 52' and towards the winding spindle 48', in which case they cooperate with springs 59' during the spot welding process for low inertia pursuit.

The weighing device 21' ascertains whether the finished spring cushion basic member 1' lies within an admissible tolerance range.

The production process for each spring cushion basic member is as follows: material 37' is withdrawn continuously from the roller 30'. In this case if the sensor 35' ascertains the rear end portion 36', then it is fixed in the region of the first welding device 40'. Furthermore a front end 38' of the material 39' is conveyed to the welding device 14'; both end pieces 36' and 38' overlap. Then the end pieces 36' and 38' are connected to each other by the welding device 14', which corresponds substantially to the second welding device 21'. The overlapping end pieces 36' and 38' are cut by the cutting device 17' so that solely the material 39' is conveyed to the first winding device 18'. The winding spindle 48' winds the material 39' until the measuring device 16' receives a pulse from the computer 11', which on the one hand interrupts the winding process by the first winding device 18' and on the other hand sends a pulse to the cutting device 17', to separate the material 39'. The electrode 52' is introduced between the part 60' (FIG. 2') which is not yet wound, of the material 39' (=layer 4') and the layer 5' of the partly wound spring cushion basic member 1'. Now, the second winding device with the comb 49' acting in opposition to the material winding direction E ensures that the part 60' is wound. .The spring cushion basic member has the final shape illustrated in FIG. 1. For attaching the end piece 7', the spot welding electrodes 54', 55', 56', 57', 58' are brought into operative connection with the electrode 52' individually or independently of each other. The finished spring cushion basic member 1' is conveyed to the weighing unit 21'. In this case it is ascertained whether its weight lies within an admissible tolerance range. In the case of deviation therefrom, the computer stops the production sequence and by way of the measuring system makes an adjustment until the weight of the respective spring cushion basic member conforms to the tolerances.

I claim:

1. Apparatus for producing coils of spring steel material comprising:

(a) a spring steel material strip unwinding station (168–182), (b) an intermittently operating cutting station (14), (c) a motor driven winding spindle (16) which contains material gripping means (38) on its peripheral surface, (d) conveying means (20) for conveying the spring steel material (10) from the cutting station (14) to the winding spindle (16) in a defined plane of movement, (e) said gripping means (38) comprising a plurality of gripping wires that are inclined at an angle to a tangent of the peripheral surface of the winding spindle (16) and which have ends which are positioned to press against said spring steel material (10) and facilitate winding thereof about said winding spindle (16).

2. Apparatus according to claim 1 wherein said angle is approximately 30°.

3. Apparatus according to claim 1 wherein the gripping wires (38) are made from spring steel.

4. Apparatus according to claim 1 wherein the conveying means (20) comprises an arm that is reciprocal in a linear manner between the cutting station (14) and the winding spindle (16) and is provided with gripping wires (36) that are inclined with respect to the plane of movement of said spring steel material (10).

5. Apparatus according to claim 4 wherein the gripping wires (38) are made from spring steel.

6. Apparatus according to claim 4, characterized in that the angle of inclination of the gripping wires (36) provided on the conveyor arm (2) is approximately 30°.

7. Apparatus according to claim 6, characterized in that a plurality of gripping wires (36) are arranged in at least one transverse row.

8. Apparatus according to claim 1 wherein the conveyor means (20) comprises an arm end section (26) able to tilt about a shaft lying in the plane of movement and which is transverse with respect to the direction of movement of the spring steel material (10).

9. Apparatus according to claim 8 wherein said arm end section (26) is biased by a spring (34) in the main plane of the conveyor means (20).

10. Apparatus according to claim 1 wherein the conveyor means (20) is connected to the output part of a controllable linear motor (144–150).

11. Apparatus according to claim 1 wherein the cutting station (14) and a guide (144, 146) for the conveyor means (20) are located on a common auxiliary frame (160), which is able to tilt about a direction (162) perpendicular to the conveying direction of the material (10).

12. Apparatus according to claim 1 which includes a pressing device (40) that is associated with the winding spindle (16) and which runs in a resiliently yielding manner on the outermost layer of the material coil (60) being formed.

13. Apparatus according to claim 12 wherein the pressing device (40) comprises a plurality of pressing fingers (48) that are axially spaced.

14. Apparatus according to claim 13 which includes a fixing station (188) for the end of the material, which comprises at least one fixing head (46; 208) able to move between the pressing fingers (48).

15. Apparatus according to claim 1 which includes a fixing station (188) for the end of the material which cooperates with a flat support member (44) that can be wound in below at least one of the outer layers of the coil (60).

16. Apparatus according to claim 15 which includes a drive (230) for axially moving the support member (44) into the coil (60) and out of the coil as well as a second drive (110–128) for rotating the pressing device (40) about the axis of the winding spindle (16).

17. Apparatus according to claim 14 which includes a controllable brake (96) cooperating with the winding spindle (16).

18. Apparatus according to claim 14 wherein the fixing station (188) is adjustable (196, 198) perpendicularly to the axis of the winding spindle.

19. Apparatus according to claim 14 wherein the fixing heads are microwelding heads (208).

20. Apparatus according to claim 19 wherein the microwelding heads (208) have electodes (210) biased resiliently into an extended position.

21. Apparatus according to claim 19 wherein the microwelding heads (208) are moved by associated servo drives (204) in succession, individually towards the outer surface of the coil (60).

22. Apparatus according to claim 19 wherein the fixing heads are staple or needle heads (50, 52).

23. Apparatus according to claim 19 wherein the fixing heads (46) have adhesive delivery channels (62).

24. Apparatus according to claim 1 which includes an ejection station (190), which comprises a stripping member (246) provided with material gripping means (248) and a drive device (234, 254, 256) for moving the stripping member (246) towards the outer surface of a finished coil (60) and for the subsequent axial movement of the stripping member (246).

25. Apparatus according to claim 24 wherein the ejection station (190) includes a further drive (258), by which the winding spindle (16) is driven in a direction opposing the direction of winding.

26. Apparatus according to claim 24 wherein the ejection station (190) comprises a weighing machine (192) located below the path of the stripping member (246), onto which a coil (60) drops after being stripped from the winding spindle (16) and which is connected to a comparator (260) which produces a fault signal associated with the deviation of the actual weight of a coil from the desired weight and that the length of the material strip section forming a coil (60) is controlled by this signal.

27. Apparatus according to claim 1 wherein the cutting station (14) is adjustable (156) in the conveying direction of the material strip (10).

* * * * *

UNITED STATES PATENT AND TRADEMARK OFFICE

CERTIFICATE OF CORRECTION

PATENT NO. : 5,319,833
DATED : June 14, 1994
INVENTOR(S) : KUHL et al

It is certified that error appears in the above-indentified patent and that said Letters Patent is hereby corrected as shown below:

On the title page, Item [75] Inventor should read

Hans Kühl, Plochingen; Jörg Weinschenk, Aichwald; Martin Hoffmann, Nurtingen, all of Fed. Rep. of Germany Signed and Sealed this
Twenty-third Day of August, 1994

*Attest:*

Bruce Lehman

BRUCE LEHMAN

*Attesting Officer*

*Commissioner of Patents and Trademarks*